US009585490B2

(12) United States Patent
Pile

(10) Patent No.: US 9,585,490 B2
(45) **Date of Patent: *Mar. 7, 2017**

(54) PNEUMATIC MATTRESS

(71) Applicant: LINET SPOL. S.R.O., Slany (CZ)

(72) Inventor: Brian Pile, Hampshire (GB)

(73) Assignee: Linet spol. S.R.O., Slany (CZ)

( * ) Notice: Subject to any disclaimer, the term of this patent is extended or adjusted under 35 U.S.C. 154(b) by 0 days.

This patent is subject to a terminal disclaimer.

(21) Appl. No.: 14/961,884

(22) Filed: Dec. 7, 2015

(65) Prior Publication Data

US 2016/0081486 A1 Mar. 24, 2016

Related U.S. Application Data

(63) Continuation of application No. 13/509,953, filed as application No. PCT/GB2010/002128 on Nov. 18, 2010, now Pat. No. 9,205,011.

(30) Foreign Application Priority Data

Nov. 18, 2009 (GB) ..... 0920207.8

(51) Int. Cl.
*A47C 27/10* (2006.01)
*A47C 27/08* (2006.01)
*A61G 7/057* (2006.01)

(52) U.S. Cl.
CPC ..... *A47C 27/081* (2013.01); *A47C 27/10* (2013.01); *A61G 7/05769* (2013.01); *A61G 7/05776* (2013.01)

(58) Field of Classification Search
CPC ..... A47C 27/083; A47C 27/081; A47C 27/08; A47C 27/10; A61G 7/05769; A61G 7/05776
USPC ..... 5/710, 713, 706, 644, 654, 655.3
See application file for complete search history.

(56) References Cited

U.S. PATENT DOCUMENTS

| | | | | |
|---|---|---|---|---|
| 4,829,616 | A | 5/1989 | Walker | |
| 5,394,577 | A | 3/1995 | James et al. | |
| 5,421,044 | A | 6/1995 | Steensen | |
| 5,956,787 | A | 9/1999 | James et al. | |
| 5,966,762 | A * | 10/1999 | Wu | A61G 7/05769 5/615 |
| 6,085,372 | A | 7/2000 | James et al. | |
| 7,155,766 | B1 * | 1/2007 | Gilchrest, Jr. | A61G 7/0525 5/710 |
| 7,380,302 | B2 * | 6/2008 | Gilchrest, Jr. | A61G 7/0504 5/710 |
| 7,735,171 | B2 | 6/2010 | Kan | |
| 9,205,011 | B2 * | 12/2015 | Pile | A61G 7/05776 |

(Continued)

OTHER PUBLICATIONS

USPTO, Office Action in U.S. Appl. No. 13/509,953, filed May 15, 2015, dated Feb. 26, 2015.

(Continued)

*Primary Examiner* — Robert G Santos
(74) *Attorney, Agent, or Firm* — Thedford I. Hitaffer; Hitaffer & Hitaffer, PLLC

(57) ABSTRACT

A pneumatic mattress has two edge cells and transverse inner cells, arranged in adjacent pairs as alternate cells. An inflation hose has internal pipes, which receive alternating pneumatic pressure for the cells via extensions to connectors at both ends of cells. The edge cells are physically connected to the inner cells via the connectors.

18 Claims, 3 Drawing Sheets

(56) References Cited

U.S. PATENT DOCUMENTS

| | | | | |
|---|---|---|---|---|
| 2006/0282955 | A1 | 12/2006 | Gilchrest et al. | |
| 2007/0101504 | A1 | 5/2007 | Gilchrest et al. | |
| 2009/0119838 | A1 | 5/2009 | Kan | |
| 2012/0227186 | A1 | 9/2012 | Pile | |
| 2015/0089748 | A1 | 4/2015 | Toms et al. | |
| 2016/0081486 | A1* | 3/2016 | Pile | A61G 7/05776 5/710 |

OTHER PUBLICATIONS

International Search Report, Mar. 30, 2011, International Application No. PCT/GB2010/002128.

* cited by examiner

PNEUMATIC MATTRESS

CROSS-REFERENCE TO RELATED APPLICATIONS

This application is a continuation application of U.S. patent application Ser. No. 13/509,953 filed on May 15, 2012, which is the U.S. National Stage of PCT Application No. PCT/GB2010/002128 filed on Nov. 18, 2010, which claims priority to Application No. 0920207.8 filed on Nov. 18, 2009 in Great Britain, the disclosures of which are incorporated herein by reference.

BACKGROUND OF THE INVENTION

The present invention relates to a pneumatic mattress.

A pneumatic mattress is a mattress having a plurality of pneumatic cells which are so connected that sets of them can be selectively and cyclically pressurized and exhausted—or inflated and deflated—in sequence to support a user, normally a patient liable to suffer or actually suffering from pressure sores. Cycling the mattress simulates movement that a patient would make if fit and healthy so as to avoid supporting his/her weight in the same place all the time. Pneumatic mattress design suffers from a dichotomy that separate independent cells held together only by an outer cover make for simplicity and cheapness, whereas integrally fabricated and smaller cells provide support in such a way that portions of the patient's anatomy are not liable to slip between two pressurized cells when an intervening one is deflated.

Pneumatic mattresses are usually pressurized with air drawn from the ambient atmosphere. However, the term is not intended to preclude use of any other inflation gas.

It is known to provide pneumatic mattresses with upper and lower layers of cells. Often these are pressurized and exhausted in phase, that is the cells above each other being pressurized and exhausted together. Advantages of this are not only that in the event of accidental puncturing of a cell in the upper layer, the corresponding cell in the lower layer can guard against the patient being dropped onto a hard bed base beneath the mattress; but also that two smaller cells on top of each other have less tendency to fill the space left by a deflating neighboring cell, thus the portion of the patient supported by the neighboring cell when inflated is more certainly relieved of support by the deflating cell than would be the case if the two superposed cells were a single cell.

It is also known to provide cells as triplets in each layer, with one cell in every three being deflated at any one time.

The present invention is an improved pneumatic mattress.

SUMMARY OF THE INVENTION

The invention is directed towards a pneumatic mattress comprising an array of inner cells. Pneumatic connectors are secured to the inner cells and arranged along the array at edges thereof. Longitudinal edge cells extend along the array at its edges. An interconnection is spaced along the longitudinal edge cells and adapted for physical connection to the pneumatic connectors, for connecting the edge cells to the inner cells, thereby providing physical connection of the longitudinal edge cells at both sided of the mattress via the intervening inner cells.

At least some of the inner cells could be longitudinal cells, that is parallel with the edge cells, with a plurality of the pneumatic connectors being provided between the edge cells and the longitudinal inner cells or outer ones thereof.

Normally the inner cells, or a majority of them, will be transverse cells extending directly between the edge cells.

The inner cells can be provided with pneumatic connectors at both ends, or a pneumatic connector at one of its ends for physical connection to one edge cell and be neighboringly connected to at least one other one of the transverse cells having a pneumatic connector at the other end for physical connection to the other edge cell.

Additionally, the inner cells can be as a single integrated unit or as one or more groups.

It is envisaged that usually the mattress will comprise a single layer of cells, but equally it could have two layers of cells.

Further, the cells, or at least the inner ones, can be pneumatically connected in pairs or in triplets for their inflation and deflation cycling.

The preferred interconnection means is a strip along the inside edge of the longitudinal cells, with a series of apertures sized and arranged to interconnect physically with the pneumatic connectors of the inner cells. Conveniently the strip is a continuation of sheet material of which the edge cell is constructed.

Alternatively, the interconnection means can be a respective sleeve inside each of the longitudinal cells, each sleeve having a series of apertures sized and arranged to interconnect physically with the pneumatic connectors of the inner cells.

Whilst the apertures for all the pneumatic connectors of the inner cells at the one side of the mattress could be aligned, conveniently they are arranged in a number of lines corresponding to the number of sets of cells alternatingly inflated, that is two lines where the cells are inflated in pairs and three lines where the cells are inflated in triplets.

Alternatively, to the strips, the edge cells can be provided in sleeves having the apertures. Again straps can extend from the pneumatic connectors, around the edge cells and back to the same or another connector.

Various advantages of this invention will become apparent to those skilled in the art from the following detailed description of the preferred embodiment, when read in light of the accompanying drawings.

BRIEF DESCRIPTION OF THE DRAWINGS

To help understanding of the invention, a specific embodiment thereof will now be described by way of example and with reference to the accompanying drawings, in which.

DETAILED DESCRIPTION OF THE PREFERRED EMBODIMENT

Figure 1:
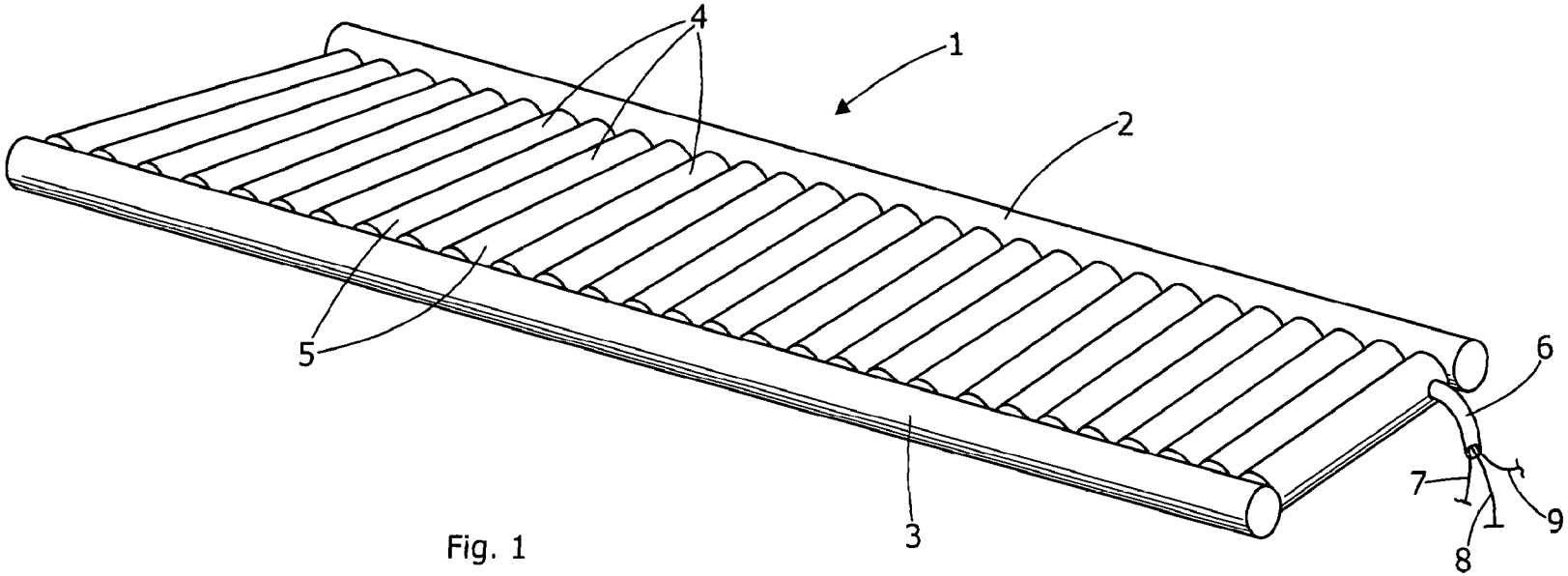
FIG. 1 is a perspective view of a pneumatic mattress according to the invention.
Figure 2:
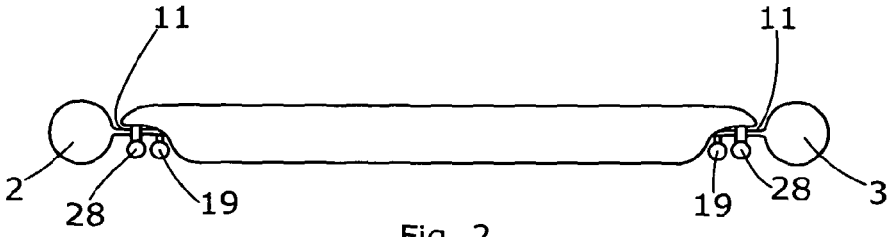
FIG. 2 is a cross-sectional end view of the mattress of FIG. 1.
Figure 3:
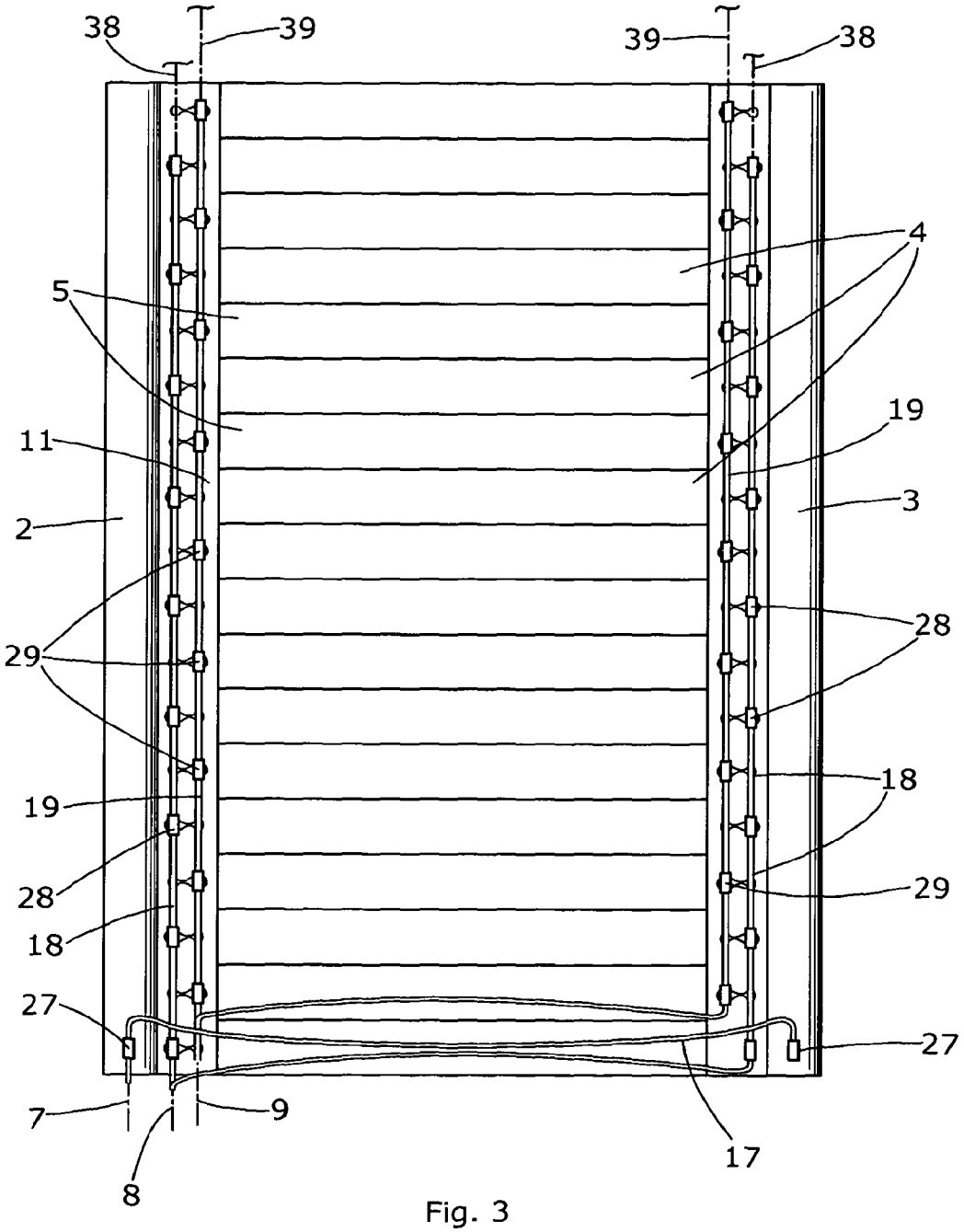
FIG. 3 is an underneath view of the mattress.
Figure 4:
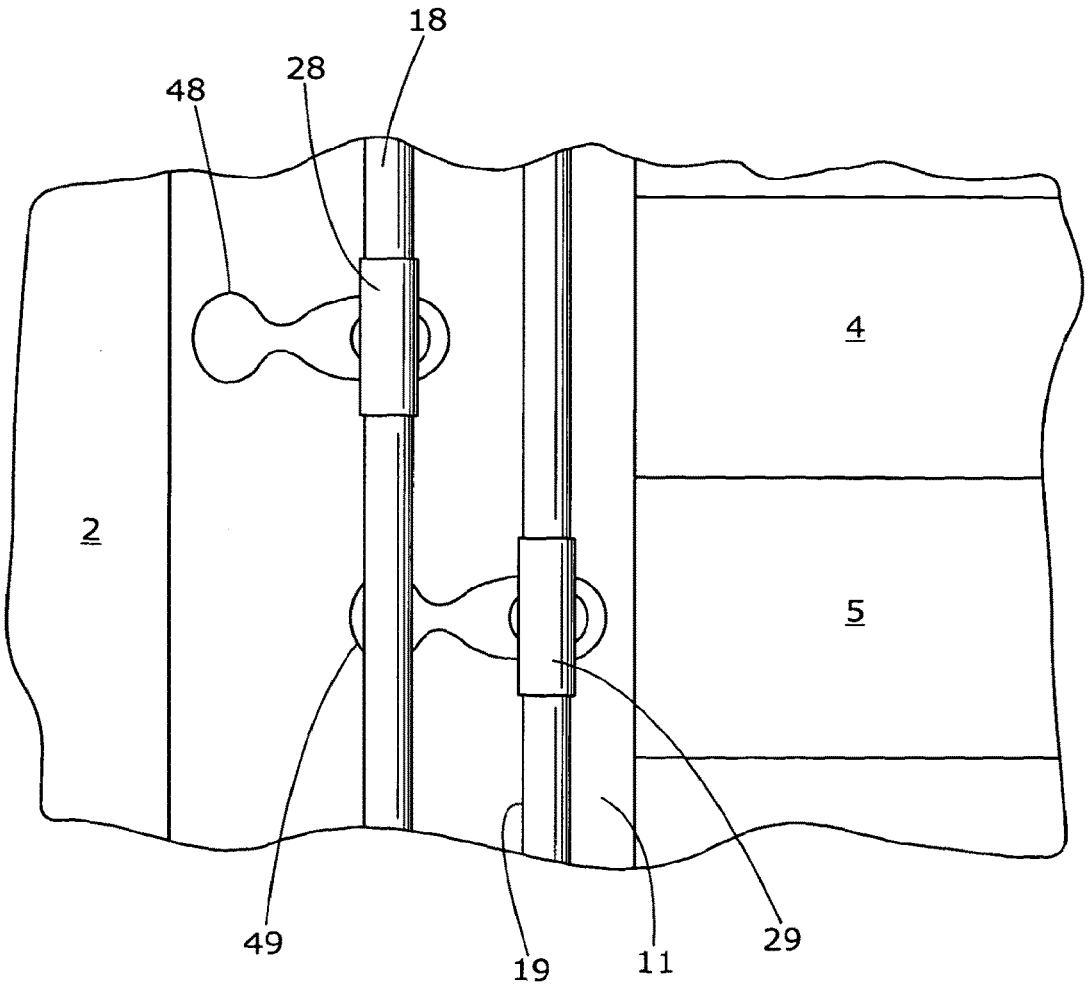
FIG. 4 is a scrap view of the mattress showing interconnections.

Referring to the drawings, a pneumatic mattress 1 has two edge cells 2,3 and an even plurality of transverse inner cells, arranged in adjacent pairs as alternate cells 4 and cells 5. An umbilical inflation hose 6 is provided with three internal pipes 7,8,9.

Pipe 7 receives constant pneumatic pressure from a controller (not shown) and is continued by at least one pipe extension 17 to pneumatic connectors 27 for the edge cells 2,3.

Pipe 8 is supplied with alternating pressure which is applied by extensions 18 to connectors 28 of cells 4.

Pipe 9 is supplied with alternating pressure which is applied by extensions 19 to connectors 29 of cells 5.

The connectors 28,29 are all—except for those for remote end cells—T connectors, in that they have a stem welded into the bottom of their respective cells 4,5. The connectors 28 are in lines 38 and the connectors 29 are in lines 39. Each cell has a connector at both ends, whereby there are lines 38 & 39 at both sides of the plurality of inner cells 4,5.

The edge cells 2,3 are formed by folding and seaming a sheet of polyurethane material leaving a pair of strips 11 on top of each other. These are provided with two lines of dumbbell apertures 48, 49 in lines corresponding in position to the lines 38,39. The apertures are rounded at both ends both for location of the connectors in them and for avoiding stress concentration.

For assembly of the mattress, each connector 28,29 is passed through its aperture 48,49 on the appropriate side of the mattress. Thus the edge cells are physically connected to the inner cells. The pipe extensions 18, 19 are added between the respective connectors, establishing the pneumatic connections to the cells. The pipe 7 is connected to the edge cells.

Thus the entire mattress is pneumatically and physically interconnected using only the connectors and the apertures in the flaps.

The invention is not intended to be restricted to the details of the above described embodiment. For instance, it is envisaged that the cells 4 could be connected at one edge of the mattress and the cells 5 could be connected at the other side of the mattress. In this arrangement every other transverse cell is connected to its edge cell, with the interconnection of neighboring transverse cells providing the edgewise connection of the mattress.

The inner cells could be provided in triplets, with two of every three cells connected at one edge and the others at the other edge.

Where the transverse cells are provided in groups, the interconnection still remains effective.

Where the inner cells or some of them are oriented longitudinally, outer ones of the inner cells can be provided with more than one connector to provide a plurality of connection points along their length. Such connectors more than one can be blanked off so that they operate mechanically only. This arrangement relies on edgewise integral connection of the inner cells for edgewise connection of the entire mattress.

Where the mattress has two layers, the edge cells can be interconnected in like manner to that just described.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A pneumatic mattress comprising:

an array of inner cells, pneumatic connectors pneumatically connected to at least corresponding ones of the inner cells and arranged along edges of the array of inner cells, longitudinal edge cells extending along edges of the array of inner cells and apertures spaced along the longitudinal edge cells through which the pneumatic connectors pass, whereby the pneumatic connectors physically connect to the edge cells to the inner cells, thereby providing a physical connection of the longitudinal edge cells at two sides of the mattress via intervening cells of the inner cells.

2. A pneumatic mattress as claimed in claim 1, wherein the intervening cells are longitudinal cells that are parallel with the edge cells, a plurality of the pneumatic connectors being provided between the edge cells and the longitudinal inner cells.

3. A pneumatic mattress as claimed in claim 2, wherein at least some of the plurality of pneumatic connectors are blanked off.

4. A pneumatic mattress as claimed in claim 1, wherein at least a majority of the inner cells are transverse cells extending directly between the edge cells.

5. A pneumatic mattress as claimed in claim 4, wherein the transverse cells have two ends and pneumatic connectors at both of the ends.

6. A pneumatic mattress as claimed in claim 4, wherein at least some of the transverse cells are physically interconnected to neighboring cells.

7. A pneumatic mattress as claimed in claim 1, wherein the inner cells are provided as a single integrated unit.

8. A pneumatic mattress as claimed in claim 1, wherein the inner cells are provided as one or more groups of cells.

9. A pneumatic mattress as claimed in claim 1, wherein the cells include a single layer of cells.

10. A pneumatic mattress as claimed in claim 1, wherein the cells include two layers of cells.

11. A pneumatic mattress as claimed in claim 1, wherein at least the inner cells are pneumatically connected via the pneumatic connectors in pairs or in triplets for cycling of their inflation and deflation.

12. A pneumatic mattress as claimed in claim 1, further comprising an interconnection which is at least one respective strip extending along an inside edge of each of the longitudinal cells, wherein the apertures are arranged along a corresponding one of the strips.

13. A pneumatic mattress as claimed in claim 12, wherein each strip is a continuation of sheet material from which a corresponding one of the edge cells is constructed.

14. A pneumatic mattress as claimed in claim 12, wherein the apertures for all the pneumatic connectors of the inner cells at the one side of the mattress are aligned.

15. A pneumatic mattress as claimed in claim 12, wherein the apertures for the pneumatic connectors of the inner cells at the one side of the mattress are arranged in a number of lines corresponding to the number of sets of cells which are interconnected for alternating inflation, including two lines where the cells are inflated in pairs and three lines where the cells are inflated in triplets.

16. A pneumatic mattress as claimed in claim 12, wherein the pneumatic connectors are T-connectors, at least for neighboring ones of the intervening cells, the T-connectors are pneumatically interconnected by longitudinal pipe extensions and the apertures are dumb-bell shaped.

17. A pneumatic mattress comprising:

an array of inner cells, pneumatic connectors pneumatically connected to at least corresponding ones of the inner cells and arranged along edges of the array of inner cells, longitudinal edge cells extending along edges of the array of inner cells, the inner cells being transverse cells extending between the edge cells, at least one of the inner cells being one continuous cell extending between the edge cells, and apertures spaced along the longitudinal edge cells and through which the pneumatic connectors pass, whereby the pneumatic connectors physically connect to the edge cells to the inner cells, thereby providing a physical connection of the longitudinal edge cells at two sides of the mattress via intervening cells of the inner cells.

18. A pneumatic mattress as claimed in claim 17, wherein each of the inner cells is one continuous cell extending between the edge cells.

* * * * *